US005791752A

United States Patent [19]

Hartman

[11] Patent Number: 5,791,752

[45] Date of Patent: Aug. 11, 1998

[54] DECORATIVE CABINET DOOR

[76] Inventor: Gerald Hartman, 204 Florence St., Sturgis, Mich. 49091

[21] Appl. No.: 893,908

[22] Filed: Jul. 11, 1997

Related U.S. Application Data

[63] Continuation of Ser. No. 14,395, Feb. 5, 1993, abandoned.

[51] Int. Cl.[6] ..... A47B 17/04; G09F 7/02; E04B 1/38

[52] U.S. Cl. ..... 312/204; 52/509; 40/611

[58] Field of Search ..... 40/611; 52/509, 52/36, 385, 389–391, 126.4; 428/46–51; 312/204, 138 R, 214; 156/71

[56] References Cited

U.S. PATENT DOCUMENTS

| | | | |
|---|---|---|---|
| 656,741 | 8/1900 | Leaver . | |
| 1,348,838 | 8/1920 | Anthony . | |
| 3,533,190 | 10/1970 | Hilfinger et al. | 49/501 |
| 4,087,143 | 5/1978 | Barnard et al. | 312/214 X |
| 4,506,482 | 3/1985 | Pracht et al. | 52/235 |
| 4,638,618 | 1/1987 | Iesaka et al. | 52/509 |
| 4,668,315 | 5/1987 | Brady et al. | 428/266 |
| 5,003,745 | 4/1991 | Fang | 52/316 |
| 5,105,597 | 4/1992 | Wilkening | 52/455 |
| 5,155,955 | 10/1992 | Ball et al. | 52/239 |
| 5,196,248 | 3/1993 | Danico et al. | 428/46 |

FOREIGN PATENT DOCUMENTS

| | | | |
|---|---|---|---|
| 2416334 | 10/1979 | France | 40/166 |

*Primary Examiner*—Michael Powell Buiz
*Assistant Examiner*—Nancy Mulcare
*Attorney, Agent, or Firm*—Howard & Howard

[57] ABSTRACT

A decorative cabinet door assembly (10) for providing an aesthetically pleasing and easily repairable outer surface for a cabinet. The door (10) includes a frame member (14) having an open section (20) disposed therewithin. A removable center panel (22) is disposed within the open section (20) and includes an array of tiles (24) disposed thereon. The tiles (24) are attached to the panel (22) by a resilient adhesive (62).

13 Claims, 1 Drawing Sheet

DECORATIVE CABINET DOOR

This is a continuation of application Ser. No. 08/014,395 filed on Feb. 5, 1993 now abandoned.

TECHNICAL FIELD

The subject invention generally relates to a decorative cabinet door assembly for providing an aesthetically pleasing and easily repairable outer surface for a cabinet.

BACKGROUND ART

Cabinets, and especially cabinet doors, vary greatly in design details. However, there are fundamentally only a few basic styles for cabinet doors. Of these styles, the most common is the frame-and-panel type construction which includes an outer frame surrounding and supporting a center panel. While decorative designs may be placed on the outer frame, most designs are focused on the center panel.

Primarily, there are two alternatives for designs of the center panel. One option is use a center panel comprising a solid piece of material with any desired decorative carvings or pictures placed thereon. For example, U.S. Pat. No. 3,533,190 to Hilfinger et al. illustrates a including a cabinet door of the aforementioned frame-and-panel type construction. The cabinet door includes an outer frame surrounding and supporting a center panel. The center panel may be free of any particular decorative designs, or in the alternative the panel may be designed with a decorative outer layer supported on a backing layer.

A disadvantage of the aforementioned design is that if any portion of the center panel becomes marked, abraded, broken, or otherwise damaged, the entire panel must be replaced to repair the damage. This problem is especially troublesome for low level cabinets that are frequently struck, forcefully shut, or closed using the foot, knee, etc. Thus, any nicks or marks must either be tolerated or else the entire center panel must be replaced.

The other option for a cabinet door design is to form the center panel out of a plurality of glass sections separated by a mullion or lattice type support structure. This style is similar to that seen in most windows and provides a classic look for the cabinet door. A disadvantage of this design is that the mullions do not provide strong for each of the glass sections. Thus, forcefully closing the door or placing any significant pressure on the door causes the entire panel to collapse, shattering the glass sections held thereby. In addition, the mullions may detract from any etching or design on the glass as they break up any design pattern and are a distraction therefrom.

SUMMARY OF THE INVENTION AND ADVANTAGES

The present invention provides a decorative cabinet door assembly for presenting an aesthetically pleasing and easily repairable outer surface for a cabinet. The assembly includes a frame member including an inner boundary and an outer boundary. The frame member includes an open section disposed within the inner boundary. A support panel is disposed within the open section in the frame member. The invention is characterized by an array of tiles affixed to the support panel to form a decorative and durable outer surface for the cabinet.

The present invention is advantageously provides a cabinet door including a plurality of tiles which can be individually replaced if worn or damaged. Furthermore, the support panel provides a strong backing for the tiles to prevent dislodgement during excessively forceful closing of the door or when pressure is placed on the door. In addition, the need for mullion-type supports between the tiles is unnecessary due to the support panel. Finally, the use of tiles is advantageous in that the cabinet door can be formed to match other tiled surfaces in the areas immediately surrounding the cabinet, e.g. the floor and/or countertop.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 2:
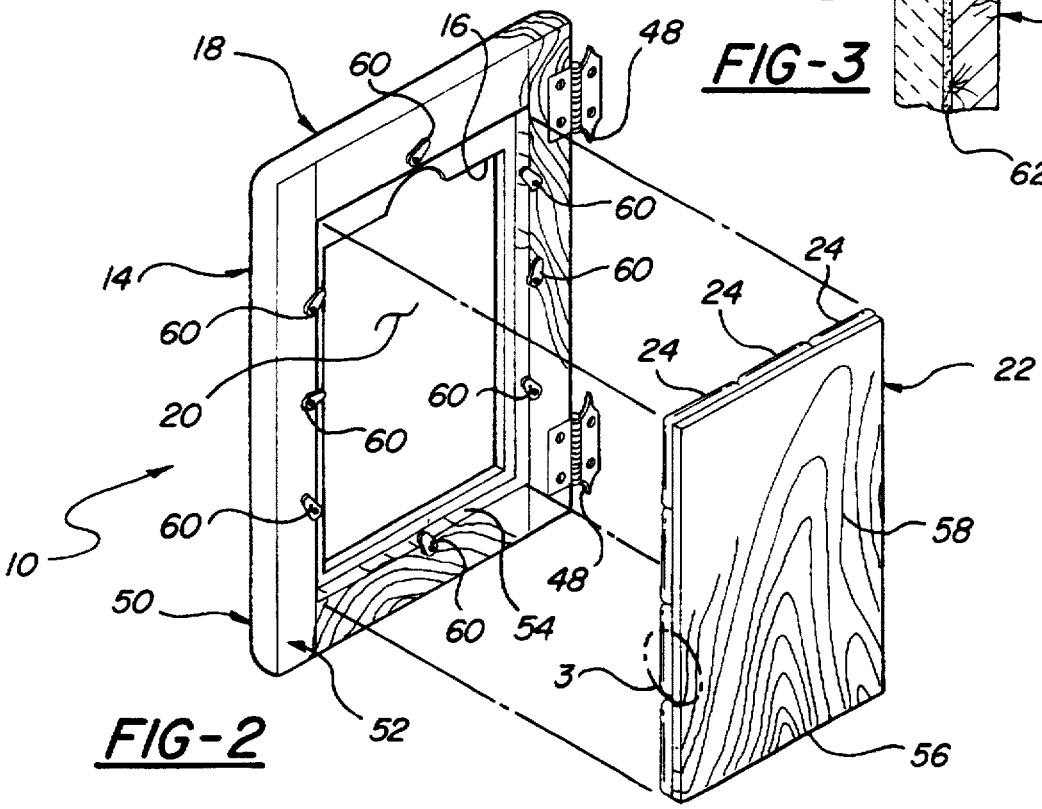
FIG. 2 is an exploded perspective view of the rear of the cabinet door.

The present invention provides a decorative cabinet door assembly 10 for presenting an aesthetically pleasing and easily repairable outer surface for a cabinet. In FIG. 2, the assembly 10 is shown including a frame member 14 including an inner boundary 16 and an outer boundary 18. The frame member 14 includes an open central section 20 disposed within and defined by the inner boundary 16. A support panel 22 is disposed within the open section 20 in the frame member 14. The invention is characterized by an array of tiles 24 affixed to said support panel 22 to form a decorative and durable outer surface for the cabinet.

Figure 1:
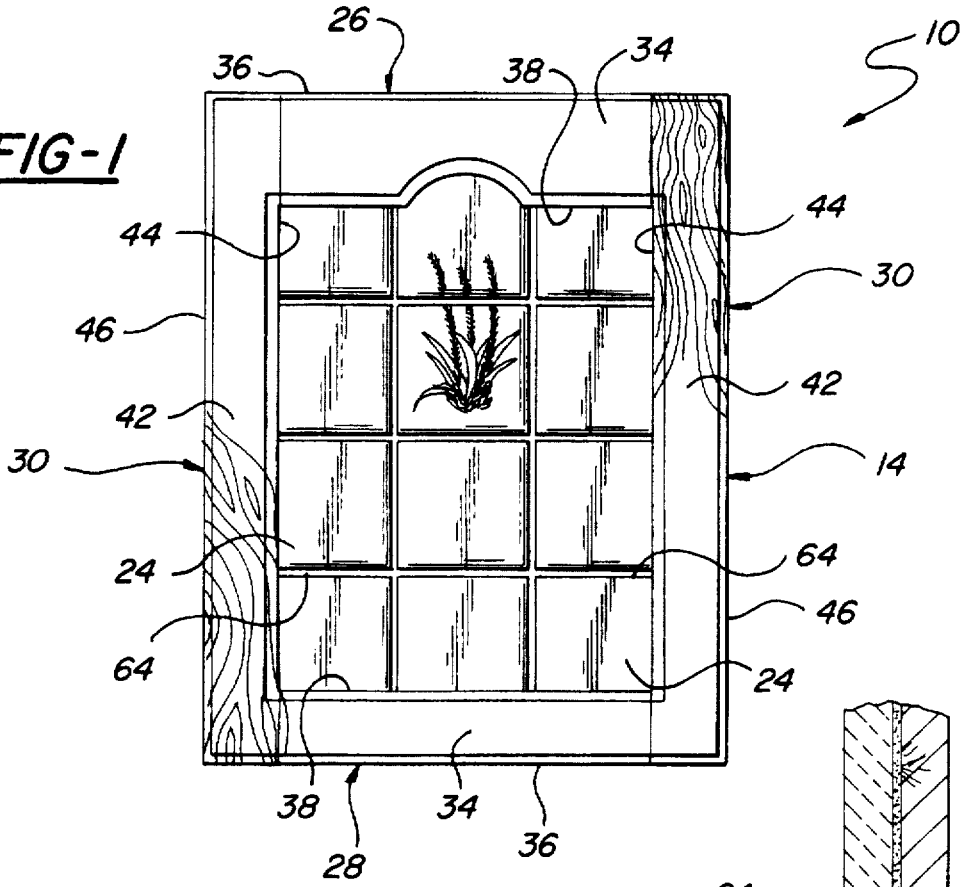
FIG. 1 is a front view of a cabinet door of the present invention.

In FIG. 1, the frame member 14 is a typical cabinet door frame member 14 including a crown rail 26, a bottom rail 28, and two stiles 30. The frame member 14 is generally made out of wood, although other materials would certainly be suitable. The crown rail 26 and the bottom rail 28 each include two ends, a front face 34, an outer edge 36, and an inner edge 38. The stiles 30 each include two ends, a front face 42, an inner edge 44, and an outer edge 46. The stiles 30 are vertically disposed and are joined along their inner edges 44 to the ends of the rails 26,28. The rails 26,28 are thus horizontally disposed and joined to the stiles 30 such that the ends of the stiles 30 are flush with the outer edges 36 of the rails 26,28. The rails 26,28 and the stiles 30 thereby form a smooth rectangular outer boundary 18. The inner boundary 16 is defined by the inner edges 38,44 of both the rails 26,28 and the stiles 30. The inner boundary 16 may be irregular in shape as shown by the concavity in the crown rail 26 in FIG. 2, or rectangular as well. The rails 26,28 and stiles 30 are joined together in any commonly known fashion in the art, such mortise and ferron dowels, etc.

In FIG. 2, hinge means 48 are shown disposed on the frame member 14 for pivotally attaching the frame member 14 to the cabinet. The hinges 48 are attached to either one of the stiles 30 depending upon the desired direction of opening for the door 10.

The frame member 14 includes a front side 50 and a back side 52. A rabbet 54 is disposed in the back side 52 of the frame member 14 and runs substantially along the inner edges 38,44 of the rails 26,28 and stiles 30. The rabbet resembles a recessed groove milled into the back side 52 of the frame member 14 and surrounding the open section 20 along the inner boundary 16 of the frame member 14.

The support panel 22 comprises a plurality of rectangular wood plys joined together in a fashion as is commonly known in the art. The support panel 22 could, however, be a single ply or could be made of a material other than wood. The support panel 22 is disposed within the open section 20 and surrounded and supported by the frame member 14. Specifically, the support panel 22 includes an outer boundary 56 which is engaged with the rabbet 54 to support the panel within the rabbet 54. The support panel 22 includes a back side 58, and the support panel is disposed within the rabbet 54 such that the back side 58 is flush with the back side 52 of the frame member 14.

Clamp means 60 are disposed on the frame member 14 for retaining the support panel 22 within the rabbet 54. The clamp means 60 preferably comprises a plurality of tabs 60 disposed at spaced intervals along the back side 52 of the frame member 14 and pivotally attached thereto. The tabs 60 pivot to overlap the rabbet 54 and the open section 20 within the frame member 14. Thus, when the support panel 22 is disposed within the open section 20 and within the rabbet 54, the tabs 60 can be pivoted into overlapping engagement with the back side 58 of the support panel 22 to retain the support panel 22 within the rabbet 54 and the frame member 14. Alternatively, although not shown, the support panel 22 may seat within a groove milled along the inner edges 38,44 of the frame 14 in lieu of the rabbet 54 and tabs 60.

A plurality of tiles 24 are disposed in a spaced relation on the support panel 22 in a predetermined pattern. Preferably, the tiles are square or rectangular and are disposed symmetrically upon the support panel 22. The tiles 24 are vertically and horizontally aligned with the stiles 30 and rails 26,28 respectively. While it is preferred to place the tiles 24 in a spaced relationship on the support panel 22, it would be possible to place the tiles 24 in contiguous relation on the support panel 22. The tiles 24 are arranged on the support panel 22 to completely cover the support panel 22.

In the preferred embodiment, the tiles 24 are ceramic tiles common to household kitchens and bathrooms. Such tiles 24 are produced in a wide possibility of colors and designs. Furthermore, such tiles can be painted or in some other way uniquely designed to personally decorate the cabinet door 10. For example, seasonal designs pertinent to the current season, e.g. Halloween or Christmas, can be placed on the tiles 24. The tiles 24 may be fabricated from wood, plastic, or other suitable and aesthetically pleasing material.

A multitude of design possibilities is encouraged by the fact that the support panel 22 is easily removable from and replaceable within the frame member 14. The tabs 60 provide a convenient way to interchange the support panels 22 within the cabinet doors 10 to permit variations in the decoration of the cabinet. This circumvents problems found in traditional cabinet doors in which the support panel is sealed within the frame member and must be forcibly removed therefrom by disassembling the frame member.

Figure 3:
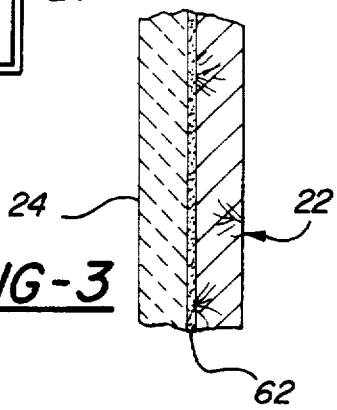
FIG. 3 is a fragmentary cross-sectional side view of a center panel of the cabinet door.

As shown in FIG. 3, the tiles 24 are joined to the support panel 22 via a resilient adhesive means 62 for flexibly bonding the tiles 24 to the support panel 22. In the preferred embodiment the adhesive means 62 comprises a silicone rubber adhesive to provide exceptional bonding strength while maintaining the flexibility of the bond. The flexibility and resiliency of the adhesive means 62 is important primarily for two reasons. First, because the support panel 22 is made out of wood, it will expand and contract as the temperature and humidity of the ambient air changes. However, the tiles 24 are ceramic, will not expand with humidity, and have a different coefficient of thermal expansion. Thus, a rigid adhesive would crack and release the tiles 24 and would not maintain the bond between the tiles 24 and the support panel 22. If the tiles 24 are made of non-ceramic material, their expansion properties will likely remain different from the support panel 22, causing the same problem which, according to this invention, is overcome by the resilient adhesive means 62.

The second advantage of the resilient adhesive means 62 is that it will keep the tiles 24 attached to the support panel 22 even if the cabinet door 10 is closed with excessive force. The concussive force from a slammed door will not disrupt the bond between the tiles 24 and the support panel 22; the resilient adhesive means 62 will maintain the bond therebetween. In particular, this problem would be aggravated since the tiles 24 are made of heavy ceramic in the preferred embodiment. In such a case, a slammed cabinet door 10 would carries a great deal of force and momentum and would be more likely to dislodge the tiles 24 were it not for the resilient adhesive means 62.

The tiles 24 of the preferred embodiment also include a resilient grout 64 therebetween. The grout 64 preferably comprises latex rubber caulk and is advantageous for the same reasons mentioned above pertaining to the resilient adhesive means 62. The grout 64 may have an opaque white color to closely match the appearance of standard ceramic tile grout. The grout also prevents dirt and grime from lodging between adjacent tiles 24.

To assemble the cabinet door 10, tiles 24 are first selected that will symmetrically cover the entire surface of the support panel 22 without overlap. Next, the tiles 24 are joined to the support panel 22 by placing a layer of the resilient adhesive means 62 therebetween. The tiles 24 are preferably placed on the support panel 22 such that there is a small, symmetrical, and rectangular gap between each tile 24 leaving a shallow channel therebetween. Next, the resilient grout 64 is placed in the channel between each tile 24 in sufficient quantity to fill the channel yet remain flush with each tile 24. The support panel 22 is then placed within the rabbet 54 in the frame member 14 and securely fastened therein by pivoting the tabs 60 into overlapping engagement therewith.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A decorative cabinet door assembly (10) comprising: a frame member (14) including a front face (50) and a rear face (52) and an inner boundary (16) and an outer boundary (18), said inner boundary (16) defining an open section (20) within said frame member (14); a support panel (22) having an outer boundary (56) smaller than said outer boundary (18) of said frame member (14); an array of tile pieces (24) affixed to said support panel (22) within said outer boundary (56) thereof; a hinge (48) disposed on said frame member (14); and characterized by a releasable fastener (60) for retaining said support panel (22) in an operative position on said frame member (14) with said tile pieces (24) substantially filling said open section (20) in said frame member (14) adjacent to said front face (50) thereof and for selectively detaching said support panel (22) from said operative position on said frame member (14) for replacement of said support panel (22) and tile pieces (24) as a unit.

2. An assembly as set forth in claim 1 wherein said releasable fastener (60) includes a plurality of tabs (60) moveably attached to said rear face (52) of said frame member (14).

3. An assembly as set forth in claim 1 wherein said rear face (52) of said frame member (14) includes a rabbet (54) extending outwardly from said inner boundary (16), said outer boundary (56) of said support panel (22) being seated in said rabbet (54).

4. An assembly as set forth in claim 3 wherein at least one of said tile pieces (24) is at least partially eclipsed from view through said open section (20) by said rabbet (54).

5. An assembly as set forth in claim 3 wherein said rabbet (54) has a depth measured perpendicularly from said rear face (52) and said support panel (22), and said tile pieces (24) have a combined thickness generally equal to said depth of said rabbet (54).

6. An assembly as set forth in claim 1 wherein said frame member (14) includes a crown rail (26), a bottom rail (28) spaced from and extending parallel to said crown rail (26), and a pair of stiles (30) spaced parallel to one another and perpendicularly adjoining said crown (26) and bottom (28) rails.

7. An assembly as set forth in claim 6 wherein each of said crown (26) and bottom (28) rails and said stiles (30) are formed of wood.

8. An assembly as set forth in claim 6 wherein each of said tile pieces (24) are spaced from the next adjacent said tile pieces (24) to form aligning spaces therebetween, said spaces extending parallel and perpendicular to said crown (26) and bottom (28) rails and said stiles (30).

9. An assembly as set forth in claim 8 further including a resilient grout (64) disposed in said spaces between adjacent said tile pieces (24).

10. An assembly as set forth in claim 9 wherein said resilient grout (64) includes latex rubber caulk.

11. An assembly as set forth in claim 1 further including a resilient adhesive (62) operatively disposed between each of said tile pieces (24) and said support panel (22).

12. An assembly as set forth in claim 11 wherein said resilient adhesive (62) includes silicone.

13. An assembly as set forth in claim 11 wherein each of said tile pieces (24) are formed of ceramic.

* * * * *